US005566887A

United States Patent [19]

Wymaster, Jr.

[11] Patent Number: 5,566,887

[45] Date of Patent: Oct. 22, 1996

[54] MULTI-VENT AIRBLAST ATOMIZER AND FUEL INJECTOR

[76] Inventor: Andy Wymaster, Jr., 2831 Alne Dr., Hemet, Calif. 92343

[21] Appl. No.: 287,631

[22] Filed: Aug. 8, 1994

[51] Int. Cl.[6] ..... B05B 7/08

[52] U.S. Cl. ..... 239/419.3; 239/422; 239/424.5; 239/434; 239/406

[58] Field of Search ..... 239/400, 402, 239/403, 405, 406, 418–419.3, 422–424.5, 426–431, 433, 434, 314

[56] References Cited

U.S. PATENT DOCUMENTS

| | | | |
|---|---|---|---|
| 1,326,483 | 12/1919 | Doran | 239/426 |
| 1,461,873 | 7/1923 | Grote | 239/419.3 |
| 1,462,680 | 7/1923 | Bliss | 239/427.3 |
| 1,777,141 | 9/1930 | Howden | 239/419 |
| 2,143,958 | 1/1939 | Pontius, Jr. | 239/419 |
| 2,582,805 | 1/1952 | Trumbour et al. | 239/426 |
| 2,623,786 | 12/1952 | Wille | 239/427.3 |
| 3,044,713 | 7/1962 | Ellis | 239/314 |
| 3,050,374 | 8/1962 | Burt et al. | 239/419.3 |
| 3,770,209 | 11/1973 | Wilcox | 239/434 |
| 4,157,160 | 6/1979 | Waldron | 239/419 |
| 4,413,784 | 11/1983 | Dea | 239/426 |
| 5,165,606 | 11/1992 | Pelet | 239/427.3 |

*Primary Examiner*—Karen B. Merritt
*Attorney, Agent, or Firm*—Robert M. Sperry

[57] ABSTRACT

An improved atomizer nozzle having a central primary orifice which initially picks up the fuel and which is surrounded by a plurality of secondary orifices which enhance the atomization quality by further reducing the droplet size and regulating the spray pattern, droplet velocity and which can cooperate with a vortex body to create recirculation to further improve combustion.

2 Claims, 2 Drawing Sheets

MULTI-VENT AIRBLAST ATOMIZER AND FUEL INJECTOR

BACKGROUND

FIELD OF INVENTION

This invention relates to fuel injectors and is particularly directed to improved atomizers and fuel injection nozzles for use in low and varying firing rate applications.

PRIOR ART

It has long been common to use atomizers and fuel injectors of various sorts to introduce fuel into the combustion zones of fuel oil burners, gas and diesel turbine, gas engines and the like. Such applications require very small drop sizes for maximum efficiency of fuel combustion and fuel heat release. This is particularly important for low and variable firing rate applications, such as residential fuel oil furnaces, which often involve fuel flow rates in the range of 0.1–0.5 gallons per hour. Hence, on-going research has been conducted toward minimizing drop size and improving the spray patterns. One prior art method of providing small drop size relies upon a so-called "pressure atomizer", which relies upon a pump to drive fuel under high pressure through a small orifice in a nozzle. However, such systems are highly subject to clogging of the nozzle, especially when orifice sizes become small, as required for low flow rate operations. Furthermore, variable flow rates are difficult to achieve with pressure atomizers, since the atomization quality is largely determined by the size of the nozzle orifice. An alternative method of atomization is "airblast" atomization, in which air is forced through a single orifice and either entrains the liquid fuel, as in the case of siphon atomizers using a coaxial injector or is forced through the fuel with a single air blast, in which case atomization is determined by hole size and air pressure. However, it is found that single orifice airblast atomizers are limited in performance by the fact that any given orifice size is restricted to a specific air flow rate at any given pressure. This, of course, effects and limits the quantity of fuel which a given orifice can properly atomize. While preferable to pressure atomizers for variable fuel flow rate operations, the single airblast atomizers are still limited to a very narrow range of flow rates in which they can operate properly. However, airblast atomizers can operate over some range of fuel flow rates, since higher air pressures can be used to breakup a larger quantity of fuel flow, the higher air pressure also serves to increase the droplet velocity, which can create ignition problems and may require the use of larger combustion zones. On the other hand, the use of larger orifices with lower air pressure can result in a decline in atomization quality. Also, variation in the orifice size and air pressure may cause changes in the spray angle which is important for proper combustion in many applications. Thus, none of the prior art atomization techniques have been entirely satisfactory.

BRIEF SUMMARY AND OBJECTS OF INVENTION

These disadvantages of the prior art are overcome with the present invention and improved methods and apparatus for atomization are provided which yield increased ability to atomize fuel into a fine mist over a wide range of fuel flow rates, of the order of 0.1–2.0 gallons per hour, with minimal change in atomization quality and without changing air pressure and which permits use of a plurality of orifice size, placement and angle combinations which allow the atomizer to be "sized" and balanced to the desired fuel flow rate or range and to permit control of the angle, direction, swirl or convergence of the air stream.

These advantages of the present invention are preferably attained by providing an improved atomizer nozzle having a central primary orifice which initially picks up the fuel and which is surrounded by a plurality of secondary orifices which enhance the atomization quality by further reducing the droplet size and regulating the spray pattern, droplet velocity and which can cooperate with a vortex body to create recirculation to further improve combustion.

Accordingly, it is an object of the present invention to provide improved methods and apparatus for achieving fuel atomization.

Another object of the present invention is to provide improved methods and apparatus for achieving fuel atomization which yields increased ability to atomize fuel into a fine mist.

An additional object of the present invention is to provide improved methods and apparatus for achieving fuel atomization which yields increased ability to atomize fuel into a fine mist over a wide range of fuel flow rates.

A further object of the present invention is to provide improved methods and apparatus for achieving fuel atomization which yields increased ability to atomize fuel into a fine mist over a wide range of fuel flow rates of the order of 0.1–2.0 gallons per hour.

Another object of the present invention is to provide improved methods and apparatus for achieving fuel atomization which yields increased ability to atomize fuel into a fine mist over a wide range of fuel flow rates of the order of 0.1–2.0 gallons per hour with minimal change in atomization quality and without changing air pressure.

An additional object of the present invention is to provide improved methods and apparatus for achieving fuel atomization which permits use of a plurality of orifice size, placement and angle combinations which allow the atomizer to be "sized" and balanced to the desired fuel flow rate or range and to permit control of the angle, direction, swirl or convergence of the air stream.

A specific object of the present invention is to provide improved methods an apparatus for achieving fuel atomization comprising an improved atomizer nozzle having a central primary orifice which initially picks up the fuel and which is surrounded by a plurality of secondary orifices which enhance the atomization quality by further reducing the droplet size and regulating the spray pattern, droplet velocity and which can cooperate with a vortex body to create recirculation to further improve combustion.

These and other objects and features of the present invention will be apparent from the following detailed description, taken with reference to the figures of the accompanying drawing.

DETAILED DESCRIPTION OF THE INVENTION

Figure 1:
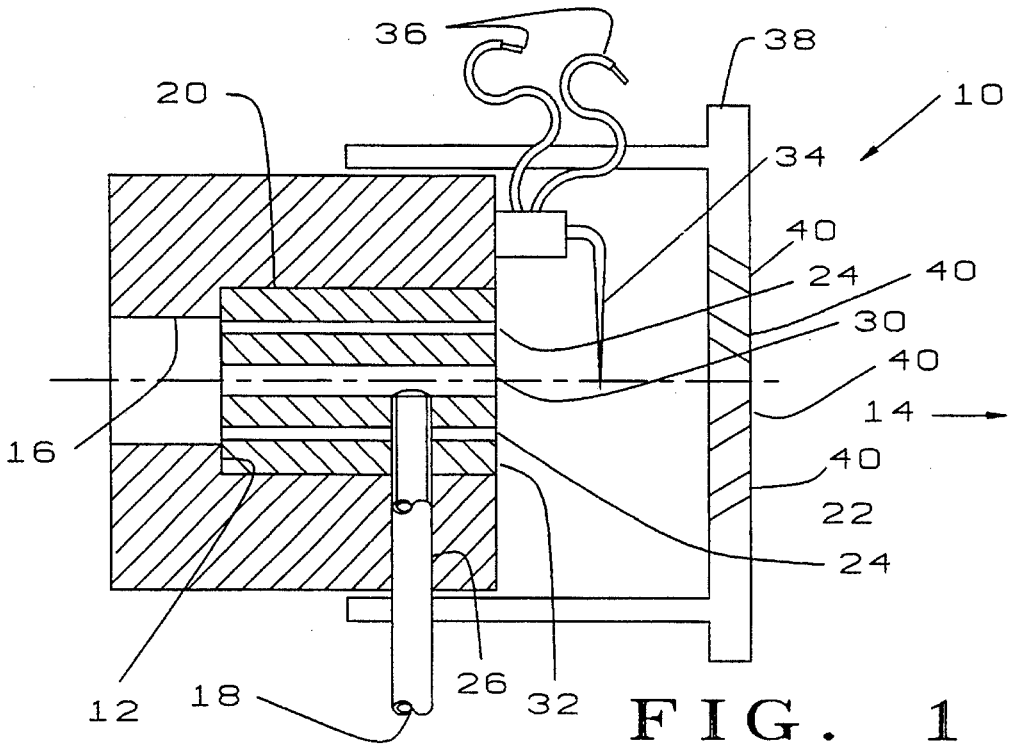
FIG. 1 is a longitudinal section through a fuel injector nozzle embodying the present invention.
Figure 2:
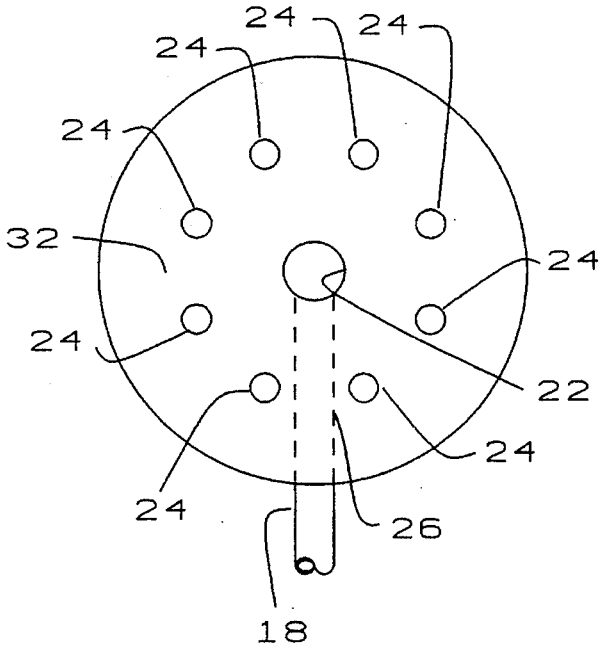
FIG. 2 is a front view of the injector nozzle of FIG. 1.
Figure 3:
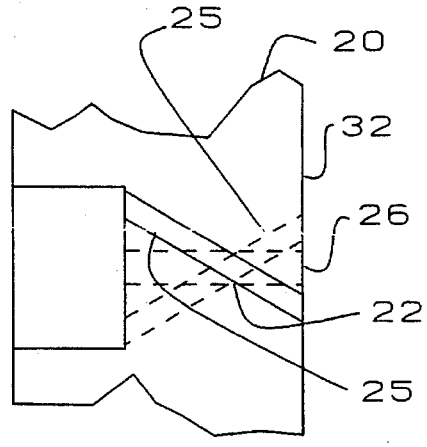
FIG. 3 is a horizontal section through an alternative form of the injector nozzle of FIG. 1.

In that form of the present invention chosen for purposes of illustration, FIG. 1 shows a fuel injector, indicated generally at 10, having a central recess 12 located adjacent one end of a combustion area, indicated by arrow 14, and communicating with a passage 16 which receives pressurized air form a suitable source, not shown. Also, fuel is delivered through tube 18 from a suitable source, not shown. An injector nozzle 20, embodying the present invention, is mounted in the recess 12 and has a central primary orifice 22 extending axially through the nozzle 20 encircled by a plurality of secondary orifices 24. The primary orifice 22 has a diameter of approximately 0.020 inch, while the secondary orifices have diameters of approximately 0.0135 inch. As noted above, the primary orifice 22 extends axially of the nozzle 20, while the secondary orifices 24 may extend parallel to the primary orifice 22, as seen in FIG. 1. Alternatively, as seen in FIG. 3, the secondary orifices 25 may extend at an angle to the axis of the primary orifice 22 so as to impart a swirling motion to air passing through the secondary orifices 24, Also, a fuel passage 26 communicates with fuel delivery tube 18 and extends vertically through the nozzle 20 to intersect the primary orifice 22 at a point 28 immediately inside the exit end 30 of the primary orifice 22, as best seen in FIG. 1, so that fuel delivered through fuel delivery tube 18 and fuel passage 26 will impinge upon the upper surface of the primary orifice 22 immediately adjacent the exit end 30 of the primary orifice 22. The fuel passage 26 should intersect the primary orifice 22 approximately 0.015 inch inward from the front wall 32 of the nozzle 20 or as close as possible to the exit end 30 of the primary orifice 22 without breaking through the front wall 32 of the nozzle 20. This placement of the fuel passage 26 optimizes atomization of the fuel while eliminating the tendency to siphon fuel into the air stream flowing through the primary orifice 22. Such siphoning is undesirable in some applications, such as where a metered fuel flow rate is desired and is accomplished by means of a fuel pump, since it tends to set up a push-pull situation causing erratic fuel flow as the atomizing air frequently draws the fuel faster than the pump delivery rate. Electrodes 34 are positioned slightly downstream from the front wall 32 of the nozzle 20 and are energized by suitable means, such as wires 36, to ignite the mixture of fuel and air flowing from the exit end 30 of the primary orifice 22. If desired, a swirling device 38, having inclined openings 40, may be mounted adjacent the exit end 30 of the nozzle 20 to impart swirling motion to the atomized mixture of fuel and air flowing from the exit end 30 of the primary orifice 22 of nozzle 20.

In use, pressurized air is delivered through passage 16 to the nozzle 20 and passes through primary orifice 22 and secondary orifices 24, while fuel is delivered through fuel tube delivery 18 and passage 26 of nozzle 20 to impinge on the upper surface of orifice 22 immediately prior to the exit end 30 of the primary orifice 22. The pressurized air passing through primary orifice 22 serves to atomize the fuel by shearing fuel from the upper end of fuel passage 26 and by blowing off any fuel clinging to the upper surface adjacent the exit end 30 of the primary orifice 22. The atomized mixture of fuel and air is delivered to the electrodes 34 for ignition and, thence, passes into the combustion chamber 14. The air flowing through the secondary orifices 24 cause further breakup and atomization of the fuel and, if desired, may provide a swirling motion, as shown in FIG. 3, to provide additional atomization or to provide a desired flow configuration to the mixture of fuel and air from the nozzle 20. Thus, with the swirling action provided by the nozzle of FIG. 3, a suction can be created adjacent face 32 of the nozzle 20 which detains movement of the mixture of fuel and air away from the exit end 30 of the primary orifice 22, extending the time which the mixture spends in the ignition area adjacent the electrodes 34 to allow complete combustion and heat release in a very small space and generally assuring creation of a "blue flame" within this space which allows the fuel to be burned at near stoichiometric levels of air.

Figure 4:
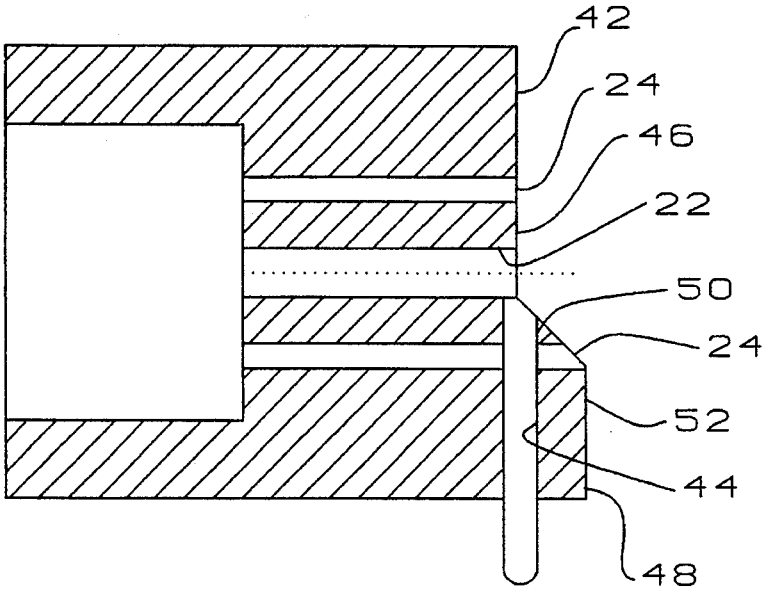
FIG. 4 is a view, similar to that of FIG. 1, showing an additional alternative form of the injector nozzle of FIG. 1.

FIG. 4 shows another alternative form of injector nozzle, indicated at 42, which is generally similar to the nozzle 20 of FIG. 1 and like elements have like reference numbers. The nozzle 42 has a central primary orifice 22 extending axially through the nozzle 42 encircled by a plurality of secondary orifices 24 extending through the nozzle 42. As shown, the secondary orifices 24 extend generally parallel to the primary orifice 22. However, as seen in FIG. 3, the secondary orifices 24 may be supplied with air from air source 2 and may be inclined with respect to the axis of the primary orifice 22 to provide swirling motion to the mixture of fuel and air from air source passing out of the primary orifice 22. In nozzle 42, the fuel passage 44 intersects the primary orifice 22 immediately in front of the upper portion 46 of the front face 48 of the nozzle 42, while the lower portion of the front face inclines outwardly and downwardly from the periphery of the fuel passage 44, as seen at 50, and then passes downward, as seen at 52. In this form of the present invention, fuel pumped through the fuel passage 44 is sprayed into the atmosphere to promote atomization immediately in front of primary orifice 22 and the upper portion 46 of the front face 48 of the nozzle 42. Also, the outer periphery of the fuel passage 44 serves as a knife-edge, so that air blowing from the primary orifice 22 will serve to shear off droplets of fuel to further enhance atomization.

Figure 5:
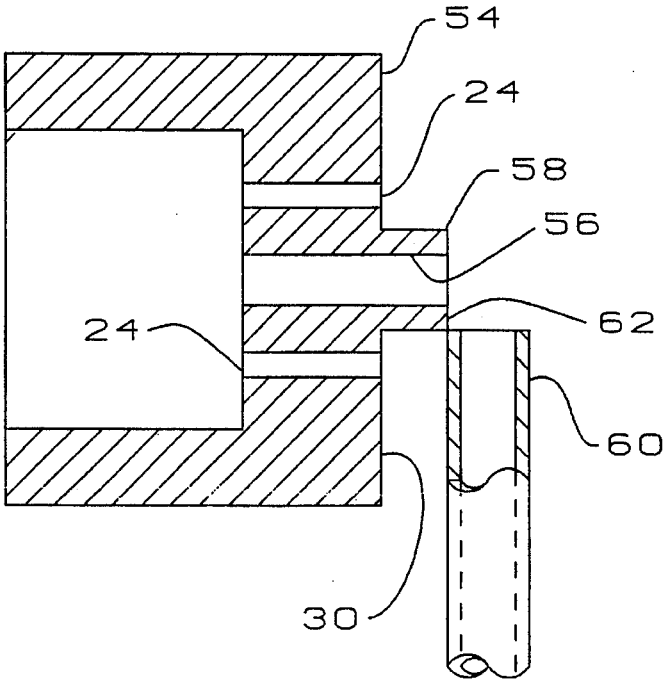
FIG. 5 is a view, similar to that of FIG. 1, showing another alternative form of the injector nozzle of FIG. 1.

FIG. 5 shows another alternative form of injector nozzle, indicated at 54, which is generally similar to the nozzle 20 of FIG. 1 and like elements have like reference numbers. The nozzle 54 has a central primary orifice 56 extending axially through the nozzle 42 encircled by a plurality of secondary orifices 24 extending through the nozzle 42. As shown, the primary orifice 56 projects forwardly from the front face 30 of the nozzle 54, as indicated at 58, and the fuel passage 50 is external of the nozzle 54 and abuts the outer end 62 of extension 58 and the primary orifice 56 in a manner similar to that employed in jet and rocket engines. As with the nozzles of FIGS. 1 and 4, the secondary orifices 24 are shown extending generally parallel to the axis of the primary orifice 56. However, as seen in FIG. 3, the secondary orifices may extend through the nozzle 54 at an angle to the axis of the primary orifice 56 to impart swirling motion to the mixture of fuel and air flowing from the primary orifice 56.

In use, it is found that each of the nozzles of the present invention serves to atomize fuel into a fine mist over a substantial range of fuel flow rates (0.1–2.0 gals./hr.) with little, if any, change in atomization quality. Furthermore, the injector nozzles of the present invention can easily be installed and replaced to provide a simple and convenient way to change the orifice diameters and, hence, to "size" and balance the device to a desired fuel flow rate or range of flow rates and to permit control of the size, shape, angle and direction of flow of the mixture of fuel and air emanating from the primary orifice of the nozzle and to control rotation and direction of movement of the effluent by proper selection of the diameters and angles of the secondary orifices and to delay movement of the effluent through the ignition area so as to provide more complete combustion and to minimize the space required for the combustion chamber.

Obviously, if desired, separate air sources could be used to supply air to the secondary orifices, independent of the air source for the primary orifice. In addition, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A fuel injector nozzle comprising:

a body having a primary orifice which initially picks up and atomizes fuel and which is surrounded by a plurality of secondary orifices positioned to deliver air downstream of said primary orifice, said secondary orifices extending through said body substantially parallel to said primary orifice, at least one source of air delivering pressurized air through said primary and secondary orifices, and a fuel passage delivering fuel perpendicular to the flow of air from said primary orifice to be atomized by the air passing through said primary orifice.

2. The nozzle of claim 1 wherein:

said one source of air comprises a first source of air delivering pressurized air through said primary orifice and a second source of air delivering pressurized air through said secondary orifices.

* * * * *